US006044994A

United States Patent [19]

Miller

[11] Patent Number: 6,044,994

[45] Date of Patent: Apr. 4, 2000

[54] SEALING ARRANGEMENT FOR CLOSURE CAPS HAVING LINERS

[75] Inventor: Albert R. Miller, Hinsdale, Ill.

[73] Assignee: Phoenix Closures, Inc., Naperville, Ill.

[21] Appl. No.: 09/128,292

[22] Filed: Aug. 3, 1998

[51] Int. Cl.[7] ..... B65D 53/04

[52] U.S. Cl. ..... 215/344; 215/44; 215/341; 215/343; 215/350; 215/351; 215/DIG. 1

[58] Field of Search ..... 215/341, 343, 215/344, 350, 351, DIG. 1, 44

[56] References Cited

U.S. PATENT DOCUMENTS

| | | | |
|---|---|---|---|
| 1,139,792 | 5/1915 | Mitchell | 215/325 X |
| 3,409,160 | 11/1968 | Scott | 215/351 X |
| 4,640,428 | 2/1987 | Chang | 215/351 X |
| 5,667,089 | 9/1997 | Moore | 215/351 |

FOREIGN PATENT DOCUMENTS

| | | | |
|---|---|---|---|
| 1049059 | 4/1954 | France | 215/DIG. 1 |
| 969785 | 6/1949 | Germany | 215/350 |
| 2061936 | 6/1972 | Germany | 215/344 |

*Primary Examiner*—Allan N. Shoap
*Assistant Examiner*—Rodrigo L. Eichwald
*Attorney, Agent, or Firm*—Welsh & Katz, Ltd.

[57] ABSTRACT

A sealing arrangement is provided having a container neck having a sloped land surface. The sloping land surface is configured to prevent the liner from slipping across the land surface when the cap is applied to the container. The cap has depending downwardly from its inner surface an annular bead positioned relative to the land surface such that, when the cap is applied to the container, the bead extends down into the mouth of the container radially inwardly of the land surface. The land surface, together with the bead, stabilize and stretch the liner upon application of the cap, urging the liner to conform to the land surface. At least one sealing rib depends downwardly from the lower surface of the cap to provide additional sealing force between the liner and the land surface.

17 Claims, 1 Drawing Sheet

SEALING ARRANGEMENT FOR CLOSURE CAPS HAVING LINERS

This invention relates generally to a sealing arrangement for closure caps that use sealing liners, and more specifically, to a unique land surface configuration on the container that cooperates with a bead on the closure to compress and stretch the liner down and around the mouth of the container.

BACKGROUND OF THE INVENTION

The closure seal and container industries are constantly striving for improvements to better seal and contain products, particularly liquid products or food products that are susceptible to spoilage or contamination. Accordingly, zero leakage and total containment of container contents is the ultimate goal. The closure and container industry have been able to provide sealing arrangements that do, for the most part, perform an adequate sealing and containment function. However, there remains room for improvement. Another factor that influences the sealing and containing features of containers is the manufacturing processes, which are themselves far from flawless.

In manufacturing the containers and the closures, the blow molding, extrusion or other processes used to make them, are apt to create imperfections either in the upper surface of the closure or, more typically, on the land surface of the container mouth. These imperfections, such as bubbles, holes, lumps and the like, can interfere with the proper sealing of the closure to the container, thereby rendering the sealing arrangement partially or fully ineffective. To alleviate this problem a second or base liner is often used to improve the seal and counter any imperfections on the container mouth or in the closure. Also, various arrangements of sealing beads, ribs or abutments, either alone or in combination with liners, have been used to increase the sealing engagement between the closure and the container mouth. Although effective, these inventions have not solved the problem entirely.

Accordingly, there is a strong need for a sealing arrangement between the container mouth and the closure that will increase sealing and containment without increasing manufacturing costs or requiring complex manufacturing techniques.

SUMMARY OF THE INVENTION

A container defines a neck that has formed on its upper end a land surface. The land surface is uniquely configured in that it is angled or sloped. Preferably, the slope is downward from an inner surface to an outer surface of the finish. The sloping land surface has formed at an upper most end a wedged point that prevents the liner from slipping across the land surface when the cap is being applied onto the container.

The closure cap has depending downwardly from its inner surface an annular bead or several individual fingers positioned relative to the land surface such that when the closure cap is applied to the container the bead or finger extends down into the mouth of the container radially inwardly from the land surface. The bead or fingers grip and stretch the liner down into the mouth of the container and around the land surface. The wedged point on the land surface, in cooperation with and the bead or fingers, stabilize the liner and force it to conform to the land surface, especially at one of either the outer or inner points on the land surface.

The invention further includes at least one sealing rib downwardly depending from the lower surface of the closure cap. The sealing rib is formed outwardly, away from the bead and is positioned relative to the container such that the sealing rib is in vertical alignment with the land surface. The sealing rib directs the liner down against the land surface to provide an additional sealing engagement between the liner and the land surface upon application of the closure cap to the container.

BRIEF DESCRIPTION OF THE DRAWINGS

Further objects of the invention, taken together with additional features contributing thereto and advantages occurring therefrom, will be apparent from the following description of the invention when read in conjunction with the accompanying drawings, wherein.

DETAILED DESCRIPTION OF THE INVENTION

Figure 1:
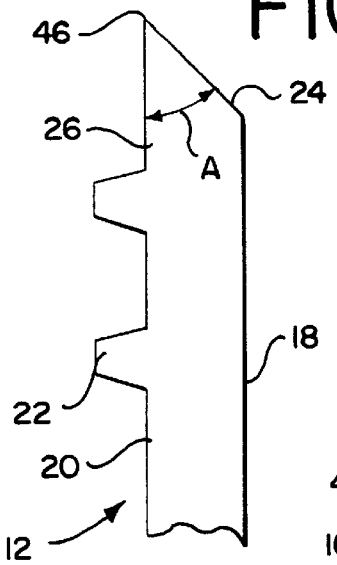
FIG. 1 is a partial cross-sectional view of a container neck showing one embodiment of the angled land surface of the present invention.
Figure 3:
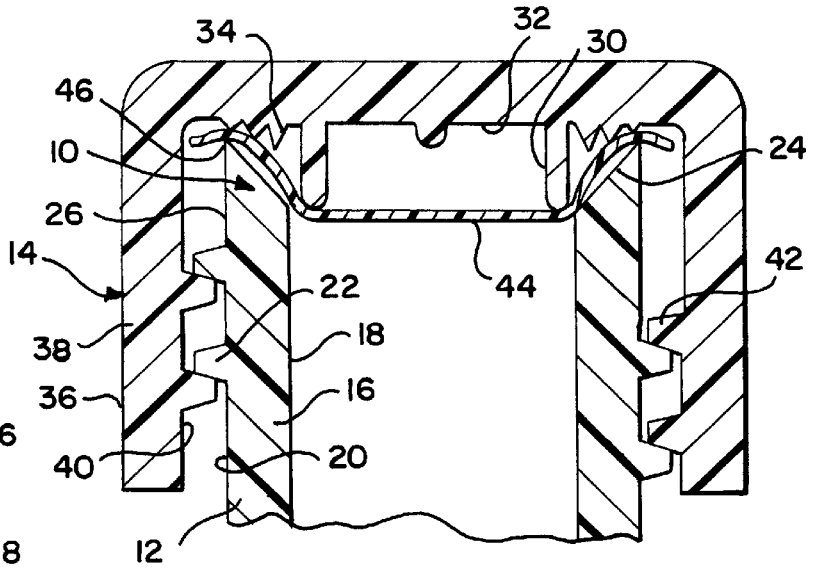
FIG. 3 is a partial cross-sectional view of a closure cap shown engaging the embodiment of the container of FIG. 1.

Referring now to the figures, and in particular to FIGS. 1 and 3, there is shown one embodiment of the present invention relating to a sealing arrangement for container closure cap systems that use closure liners. The invention is generally referred to as a sealing arrangement generally illustrated at 10. The sealing arrangement 10 comprises essentially a three part sealing system utilizing the container 12 and the closure 14.

Figure 2:
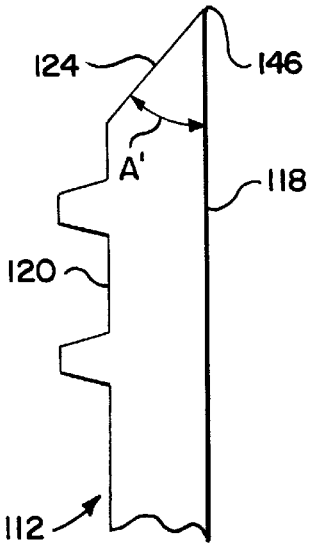
FIG. 2 is a partial cross-sectional view of an alternate embodiment of the container neck.

In FIGS. 1 and 2, only a small portion of the container 12 is shown. It is to be understood that container 12 can be a glass, polyethylene or other conventionally manufactured container. The portions of the container 12, as shown, include the neck 16 having inner wall 18 and outer wall 20. The neck 16 has threading 22 which is configured to matingly engage corresponding threading on the closure 14. As can be seen clearly in FIGS. 1 and 2, the container neck 16 terminates at a land surface 24 along an upper end 26 of the neck 16. The land 24 forms an open mouth of the container 12. The mouth allows for the ingress and egress of contents from the container 12.

Referring to FIGS. 1 and 3, the land 24 is slanted, angled or tapered in a downward direction from the outer wall 20 to the inner wall 18. This specific formation of the land 24 can easily be formed using conventional blow molding or extrusion processes or can be machined, such as by cutting or grinding. The degree of angle A of the land 24 will depend on the specific application for which the container and closure will be used. An angle A of about 45° to about 89°, and preferably about 60° to about 80° is contemplated to provide the desired sealing effect. Viewed relative to a horizontal plane passing through the top of the land surface, the angle is about 1° to about 45°, and preferably about 10° to about 30°.

The closure 14 as illustrated in FIG. 3, includes a further feature of the present invention which is the annular bead 30.

The bead 30 is integrally formed on an upper surface 32 of the closure 14 and is situated within the closure 14 such that when the closure 14 is applied to the container 12, the bead 30 is directed into the mouth of the container 12 just beyond the land 24. The bead 30 is preferably annular in order to conform to the closure 14, however, it can be formed as one or more independent nodules.

The closure 14 also includes on its upper surface 32 at least one sealing rib 34 positioned to substantially longitudinally align with the land 24. The closure 14 includes an outer surface 36 and a downwardly depending skirt 38. The skirt 38 has an inner surface 40 that includes threading 42 that is configured to matingly engage the threading 22 of the container 14.

As seen in FIG. 3, the liner 44 is configured to fit between the container 12 and the closure 14. The liner 44 is a conventional sealing liner made of, for example, paper, foil, polyethylene and/or polypropylene. Polyethylene and polypropylene are preferred because they are economical, naturally resilient and stretchable when formed into liners.

Figure 4:
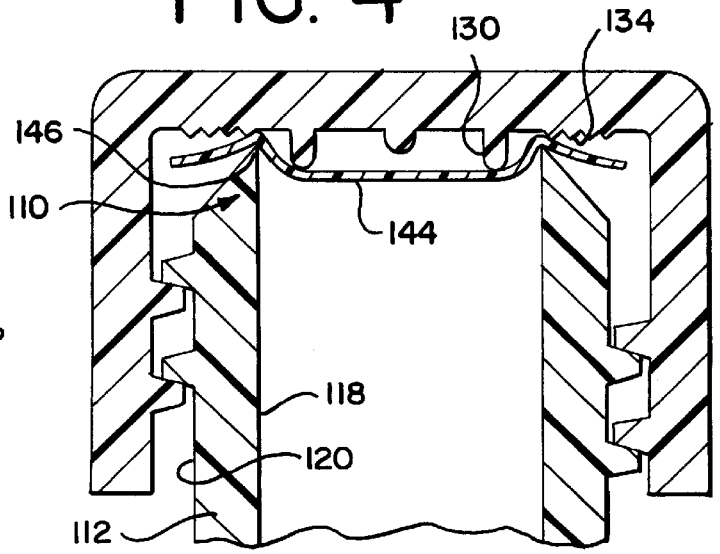
FIG. 4 is a cross-sectional view of a closure cap shown engaging the embodiment of the container of FIG. 2.
Figure 2B:
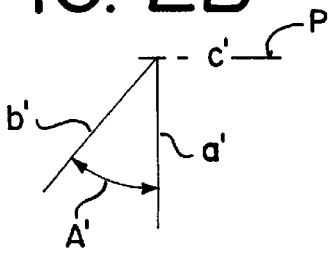
FIG. 2B is an illustration of the angular relationship of the land surface walls of the embodiment illustrated in FIG. 2.

An alternate configuration is shown in FIGS. 2 and 4, in which the land 124 is angled or slanted downwards from the inner wall 118 to the outer wall 120. Where it is desired to have land 124 angled as such, the sealing arrangement 110 functions in a similar fashion by gripping and stretching the liner 144. However, in this embodiment, the centralized gripping point 146 is located along the edge between the inner wall 118 and the land 124. The ribs 134 function to grab the liner 144 and urge it against the land 124, while providing a secondary sealing force down against the liner 144 away from the point 146. The bead 130, functions similarly in this embodiment by urging the liner 144 into the mouth of the container 112, thus stretching the liner 144 down and around the land 124 to create the conforming seal.

Figure 1A:
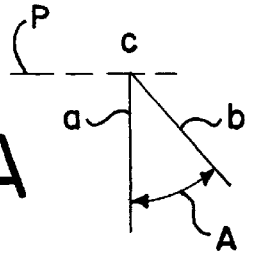
FIG. 1A is an illustration of the angular relationship of the land surface walls of the embodiment illustrated in FIG. 1.

Referring again to the configuration of the land 24 shown in FIGS. 1 and 3, the land 24 is configured such that the angle A of the slope is acute. As shown in the FIG. 1A, the leg "a" (outer wall 20) of the angle A is perpendicular to a horizontal plane (indicated at P) passing through point C, while the leg "b" (the land 24) is angled or sloped downwards from the point "c" towards the mouth of the container. Similarly, in the alternate embodiment 110, referring specifically to FIG. 2A, the angle A' that is defined by leg "a'" (inner wall 118) is perpendicular to the horizontal plane P passing through point "c'", while leg "b'", is angled or sloped downward from the point "c'" toward the outside of the container and away from the mouth.

Operation of the present sealing arrangements 10, 110 will now be explained with reference to the embodiment 10, illustrated in FIGS. 1 and 3. It is to be understood that the present discussion applies equally well to the embodiment 110, illustrated in FIGS. 2 and 4. The sealing arrangement 10 increases the amount of compressible liner to a larger portion of the surface of the land 24, especially along the edge 46 between the land 24 and the inner wall 18. As the closure 14 is torqued down against the liner 44 and the container 12, due to the threading 22 and 42, the annular bead 30 grips the liner 44 preventing it from turning with the closure while it also pushes down against the liner 44, causing the liner 44 to stretch down and around the land 24. Further, as the bead 30 grips and stretches the liner 44, the sealing ribs 34 force the liner 44 down against the land 24. Because the land 24 is angled, there is formed at its outermost edge a point 46 that also functions to grip or pinch the liner 44 as the bead 30 pushes down against the liner 44 and into the mouth of the container 12. Thus, the effect of the sloped land 24, in connection with the ribs 34, is to create a localized gripping point that securely anchors the liner 44, preventing it from turning or sliding across the land 24 while the closure 14 is being applied to the container 12.

The sealing ribs 34 can all be of the same size and shape. Alternately, the ribs 34 can be of different sizes and/or shapes to, for example, correspond to the sloping land 24. It is to be understood that the ribs 34 not only act to grip the liner in conjunction with the point 46, but also help to enhance the seal of the liner 44 by urging it against the land 24, to compensate for imperfections that may exist on the land 24. Although the gripping point 46 (and 146) is illustrated at a "sharp" point or angle, it will be understood that this point 46, 146 may in fact be rounded or finished surface.

Through application of the present sealing arrangement 10, an enhanced seal is effectuated because the liner 44, by being stretched, is urged in to conformance with the land 24. By urging the liner 44 to wrap around and conform to the land 24, the liner 44 can perform its sealing functions in situations where the land 24 may have imperfections caused during manufacturing.

While the invention has been described in connection with specific embodiments thereof, it is evident that many alternatives, modifications and variations will be apparent to those skilled in the art in light of the foregoing description. Accordingly, it is intended to include all such alternatives, modifications and variations as set forth within the spirit and broad scope of the appendant claims.

What is claimed is:

1. In combination, a closure cap and container comprising:

a container having a neck, said neck having an inner and an outer wall, said inner and outer walls terminating along their upper ends to create a land surface therebetween, said inner and outer walls presenting cylindrical surfaces at the upper ends adjacent to said inner land surface, said land surface defining a mouth allowing for ingress and egress of contents stored in said container, said land surface sloping from said inner wall to said outer wall;

a closure liner; and a closure cap adapted to receive said closure liner, said closure cap having a top panel with an upper and a lower surface and an integrally depending annular skirt, said annular skirt and said top panel defining a container receiving area, said closure cap having formed on said upper surface within said container receiving area liner compression means for gripping and stretching said closure liner down into said mouth of said container and around said land surface, thereby creating a conforming seal of said closure liner between said closure cap and said land surface, said liner compression means being inwardly spaced from said container neck inner wall.

2. The closure cap and container combination as defined in claim 1, wherein said land surface slopes downwardly from said inner wall to said outer wall.

3. The closure cap and container combination as defined in claim 1, wherein said land surface slopes downwardly from said outer wall to said inner wall.

4. The closure cap and container combination in accordance with claim 1 wherein said land surface slopes at an angle of about 1° to about 45° relative to a horizontal plane.

5. The closure cap and container combination as defined in claim 1, wherein said land surface includes liner gripping means formed as a wedged point formed along said upper most end of said land surface.

6. The closure cap and container combination as defined in claim 1, wherein said liner compression means includes at least one downwardly depending bead positioned relative to said land surface such that upon application of said closure cap to said container, said bead extends down into said mouth radially inwardly from said land surface.

7. The closure cap and container combination as defined in claim 6, wherein said liner compression means further includes at least one sealing rib downwardly depending from said lower surface of said closure cap, said at least one sealing rib being formed outwardly away from said bead and positioned relative to said container such that said at least one sealing rib is in vertical alignment with said land surface urging said closure liner down against said land surface providing a sealing engagement between said liner and said land surface upon application of said closure cap to said container.

8. In combination, a closure cap and container comprising:

a container having a neck, said neck having an inner and an outer wall, said inner and outer walls terminating along their upper ends to create a land surface therebetween, said inner and outer walls presenting cylindrical surfaces at the upper ends adjacent to said inner land surface, said land surface defining a mouth allowing for ingress and egress of contents stored in said container, said land surface being sloped;

a closure liner; and a closure cap having a top panel with an upper and a lower surface and an integrally depending annular skirt, said closure cap configured to receive said closure liner, said annular skirt and said top panel defining a container receiving area, said closure cap having formed on said upper surface within said container receiving area at least one downwardly depending bead positioned relative to said land surface such that upon application of said closure cap to said containers, said bead extends down into said mouth radially inwardly of, and spaced from said land surface for gripping and stretching a closure liner down into said mouth of said container and around said land surface, thereby creating a conforming seal of said liner between said closure cap and said land surface.

9. The closure cap and container combination as defined in claim 8, wherein said land surface slopes downwardly from said inner wall to said outer wall.

10. The closure cap and container combination as defined in claim 8, wherein said land surface slopes downwardly from said outer wall to said inner wall.

11. The closure cap and container combination as defined in claim 8, wherein said land surface defines liner gripping means having a wedged point formed along said upper most end of said land surface.

12. The closure cap and container combination in accordance with claim 8 wherein said land surface slopes at an angle of about 1° to about 45° relative to a horizontal plane.

13. The closure cap and container combination as defined in claim 8, wherein said closure cap further includes at least one sealing rib downwardly depending from said lower surface of said closure cap, said at least one sealing rib being formed outwardly away from said bead and positioned relative to said container such that said at least one sealing rib is in vertical alignment with said land surface urging said closure liner down against said land surface to sealingly engage said liner with said land surface upon application of said closure cap to said container.

14. In combination, a closure cap having a closure liner therein and container comprising;

a container having a neck, said neck having an inner and an outer wall, said inner and outer walls terminating along their upper ends to create a land therebetween, said land defining a mouth allowing for ingress and egress of contents stored in said container, said land being sloped from said inner wall to said outerwall said inner and outer walls presenting cylindrical surfaces at the upper ends adjacent to said inner land surface;

a wedged point formed at said land for preventing said closure liner from slipping across the land when said closure cap is applied to said container;

the closure cap having a top panel with an upper and lower surface and an integrally depending annular skirt, said annular skirt and said top panel defining a container receiving area, said closure cap having formed on said upper surface within said container receiving area at least one downwardly depending bead positioned relative to said land such that upon application of said closure cap to said container said bead extends down into said mouth radially inwardly and spaced from said land for gripping and stretching said closure liner down into said mouth of said container and around said land, thereby creating a conforming seal of said closure liner between said closure cap and said land; and at least one sealing rib downwardly depending from said lower surface of said closure cap, said at least one sealing rib formed outwardly away from said bead and positioned relative to said container such that said at least one sealing rib is in vertical alignment with said land to direct said closure liner down against said land to comprise said liner and to sealingly engage said liner with said land upon application of said closure cap to said container.

15. The closure cap and container combination as defined in claim 14, wherein said land slopes downwardly from said inner wall to said outer wall.

16. The closure cap and container combination as defined in claim 14, wherein said land slopes downwardly from said outer wall to said inner wall.

17. The closure cap and container combination in accordance with claim 14 wherein said land surface slopes at an angle of about 1° to about 45° relative to a horizontal plane.

* * * * *